US005453302A

United States Patent [19]

Chaudhry et al.

[11] Patent Number: 5,453,302

[45] Date of Patent: Sep. 26, 1995

[54] IN-LINE COATING OF STEEL TUBING

[75] Inventors: Manzoor A. Chaudhry, Bensalem, Pa.; Jeffrey L. Lamber, Richton Park, Ill.; Bruce E. Laumann, Crown Point, Ind.; Edward E. Mild, Frankfort; Brian G. Muick, Country Club Hills, both of Ill.; Stephen T. Norvilas, Doylestown; David S. Pliner, Huntingdon Valley, both of Pa.; Stephen E. Seilheimer, Homewood, Ill.

[73] Assignee: Allied Tube & Conduit Corporation, Harvey, Ill.

[21] Appl. No.: 243,583

[22] Filed: May 16, 1994

[51] Int. Cl.[6] ..... B05D 1/18; B05C 11/00

[52] U.S. Cl. ..... 427/430.1; 427/348; 427/350; 118/50; 118/63; 118/64; 118/65; 118/68; 118/404; 118/405; 118/410; 118/419; 118/421; 118/602; 118/603; 118/610; 118/DIG. 11; 118/DIG. 12; 118/DIG. 13

[58] Field of Search ..... 427/348, 350, 427/430.1; 118/50, 63, 64, 65, 68, 404, 405, 410, 419, 421, 602, 603, 610, DIG. 11, DIG. 12, DIG. 13

[56] References Cited

U.S. PATENT DOCUMENTS

| | | | |
|---|---|---|---|
| 1,375,979 | 4/1921 | Taber . | |
| 1,867,476 | 7/1932 | Rogers . | |
| 1,944,777 | 1/1934 | Banks | 287/168 |
| 1,951,085 | 3/1934 | Cumfer | 91/30 |
| 1,982,915 | 12/1934 | Jenks . | |
| 2,051,634 | 8/1936 | Carroll et al. | 242/11 |
| 2,216,519 | 10/1940 | Quarnstrom | 219/12 |
| 2,287,825 | 6/1942 | Postlewaite | 25/38 |
| 2,832,993 | 5/1958 | Cox | 16/6 |
| 2,863,204 | 12/1958 | Timothy et al. | 25/38 |
| 3,084,662 | 4/1963 | Badger | 118/50 |
| 3,108,022 | 10/1963 | Church | 118/58 |
| 3,332,393 | 7/1967 | Hoover | 118/125 |
| 3,745,971 | 7/1973 | Story | 118/50 |
| 3,850,139 | 11/1974 | Frank, Jr. et al. | 118/50 |
| 3,908,593 | 9/1975 | Rossi et al. | 118/DIG. 11 |
| 4,333,417 | 6/1982 | Camp et al. | 118/405 |
| 4,479,986 | 10/1984 | Juday | 427/295 |
| 4,823,728 | 4/1989 | Sturdivant | 118/50 |
| 4,907,526 | 3/1990 | Walde et al. | 118/50 |
| 5,078,080 | 1/1992 | Schiele | 118/50 |
| 5,286,294 | 2/1994 | Ebi et al. | 118/405 |

FOREIGN PATENT DOCUMENTS

| | | |
|---|---|---|
| 514787 | 3/1921 | France . |
| 3740201A1 | 6/1989 | Germany . |
| 145442 | 3/1985 | United Kingdom . |
| 145442 | 4/1987 | United Kingdom . |

OTHER PUBLICATIONS

Brochure entitled "Vacumat©" apparently published by Schiele Maschinenbau GmbH, date unknown.

*Primary Examiner*—Shrive Beck
*Assistant Examiner*—David M. Maiorana
*Attorney, Agent, or Firm*—Banner & Allegretti, Ltd.

[57] ABSTRACT

A method and apparatus for applying a coating to a continuous length of tubing. A coating chamber having entry and exit ports substantially encloses a portion of the tubing while permitting the tubing to pass continuously therethrough. Airflow into the coating chamber through the exit port strips excess coating material from the tubing surface. Air is withdrawn from the coating chamber by vacuum pumps through one or more separation chambers which separate entrained particles or droplets of coating material from the air. The coating chamber is preferably disposed at a distance from the separation chamber(s). The vacuum line connecting the coating chamber with the separation chamber(s) is preferably flexible or breakable. The separation chambers are preferably capable of being operated in series or in parallel. Adjustable masks are preferably provided at the entry and exit ports of the coating chamber. A seal is preferably provided at the entry port.

13 Claims, 4 Drawing Sheets

IN-LINE COATING OF STEEL TUBING

BACKGROUND OF THE INVENTION

The invention relates generally to continuous manufacture of steel tubing, and relates more particularly to finishing operations.

Due to its susceptibility to corrosion, steel tubing is often coated with one or more layers of protective materials. For example, steel tubing may be galvanized by application of molten zinc, or may be coated with various other paints or coating materials, alone or in combination. It has long been known in the art that significant economies may be realized by applying coatings to the tubing in line with manufacture thereof, rather than applying coating materials in separate operations after the tubing has been cut to length. (See, e.g., application Ser. No. 08/026,432 assigned to the same assignee as the present application filed Mar. 4, 1993.)

A problem which arises in connection with in-line coating of steel tubing is that coating thickness is often difficult to control at production speeds. Air knives have been employed to blow excess coating material from the tubing, but air knives do not permit a great deal of precision to be maintained in regulating coating thickness.

Typically, coating processes require that coating thickness not fall below a minimum value needed for adequate protection of the substrate. Maximum permissible thickness may be a function of cost. That is, excessive thickness represents waste of coating material. Also, excessive thickness may make the product unacceptable by leaving visible irregularities on the product surface due to running of coating material, or by leading to insufficient drying or curing of the coating within the time available.

It is a general object of the invention to provide an improved method and apparatus for in-line coating of steel tubing to provide improved control of coating thickness.

SUMMARY OF THE INVENTION

The invention generally comprises a method and apparatus for applying liquid coating material to metal tubing in a coating chamber in-line with formation of the metal tubing, wherein coating thickness is regulated by controlled flow of air into the coating chamber about the exterior of the tubing as the tubing exits the coating chamber. The coating chamber is connected to a vacuum/supply system which supplies coating material to the coating chamber through a supply line and draws air from the coating chamber through a vacuum line into a separation chamber where entrained particles or droplets of coating material are separated from the airstream.

In accordance with a feature of the invention, the coating chamber is spaced from the vacuum/supply system, and the vacuum line is flexible or breakable so that the coating chamber can move relative to the separation chamber or break away therefrom in the event of major transverse displacements of the steel tubing due to fold-ups or other mishaps. In contrast to prior art vacuum coating equipment in which a coating chamber has been attached directly to a separation chamber and in close proximity to other system components, the system of the invention enables damage to be avoided entirely or limited to the coating chamber in the event of large displacements of the metal tubing.

In a preferred embodiment of the invention, each vacuum/supply system includes two separation chambers which are capable of functioning independently of one another, and which may be connected in parallel with one another so that one chamber may be taken off-line for maintenance while the other continues to function, without interruption of coating operations.

To facilitate positioning of the coating chamber during set-up, the coating chamber is preferably supported on an adjustable stand which enables control of both the elevation and the attitude of the coating chamber.

The invention also preferably permits rapid changeover from one coating material to another. To this end, the preferred apparatus includes at least two independent vacuum/supply systems. In accordance with a preferred method of operation, changing the coating operation from one coating material to another is accomplished by disconnecting the coating chamber from one vacuum/supply system, flushing the coating chamber and any lines that remain connected thereto, and then connecting the coating chamber to another vacuum/supply system. The coating chamber remains in place on the tubing line throughout the changeover to minimize line down time. The supply line and the vacuum line are preferably both provided with quick-disconnect fittings or other means to facilitate connection and disconnection of the coating chamber to and from the respective vacuum/supply systems. The vacuum/supply systems are preferably movable and positioned side-by-side. The vacuum ports on the respective systems are preferably positioned adjacent one another to reduce the distance that the respective units must be moved during changeovers.

DETAILED DESCRIPTION OF PREFERRED EMBODIMENTS

The invention is generally embodied in a method and apparatus for applying a coating to a continuous length of tubing 16. The apparatus includes a coating chamber for substantially enclosing a portion of the tubing while permitting the tubing to pass continuously through an entry port 12 and exit port 14 which are disposed at opposite ends of the coating chamber. Liquid coating material is flooded onto the tubing in the coating chamber.

Figure 1:
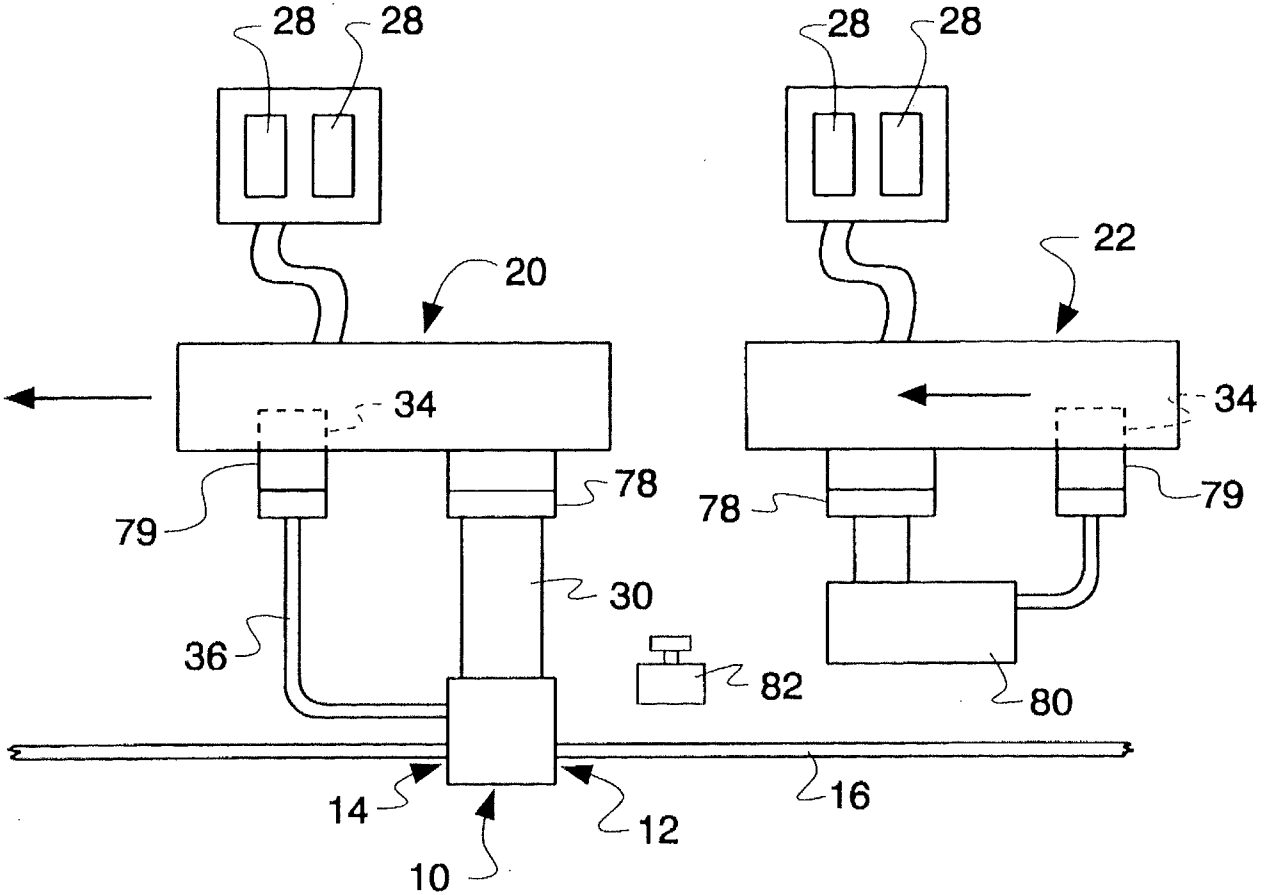
FIG. 1 is a diagrammatic plan view of coating apparatus in accordance with the invention.
Figure 3:
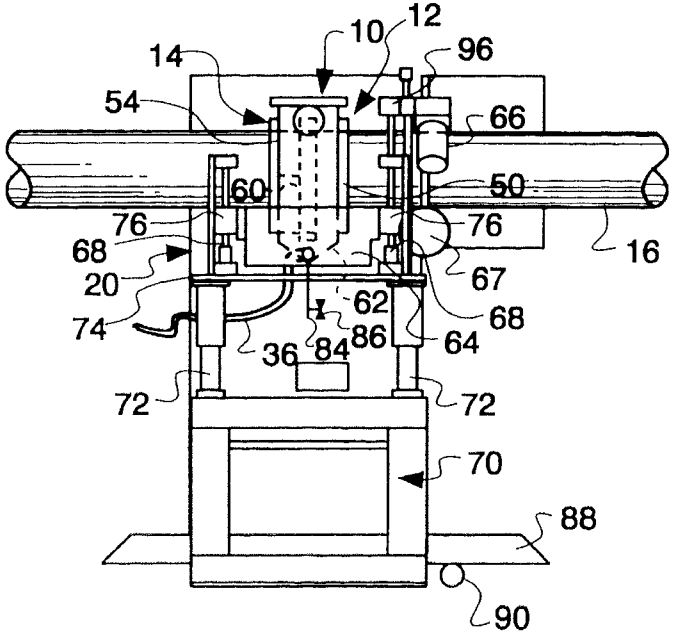
FIG. 3 is a diagrammatic front elevational view of a portion of the apparatus shown in FIG. 1.
Figure 2:
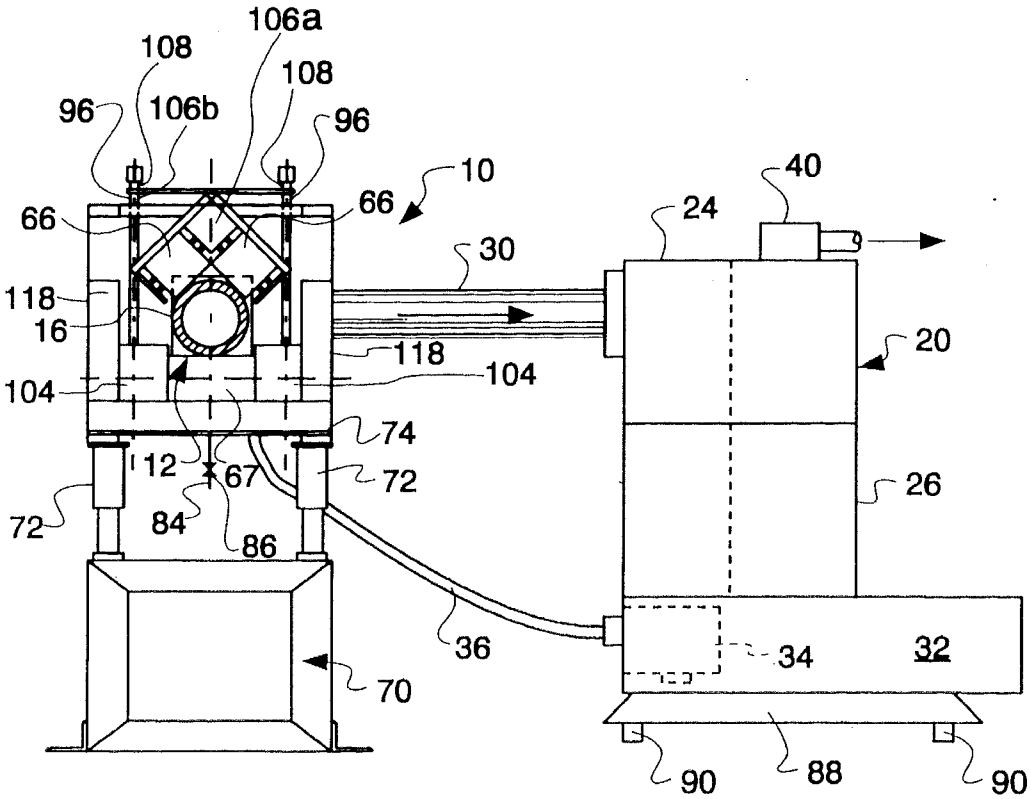
FIG. 2 is a diagrammatic side elevational view of a portion of the apparatus shown in FIG. 1.
Figure 3A:
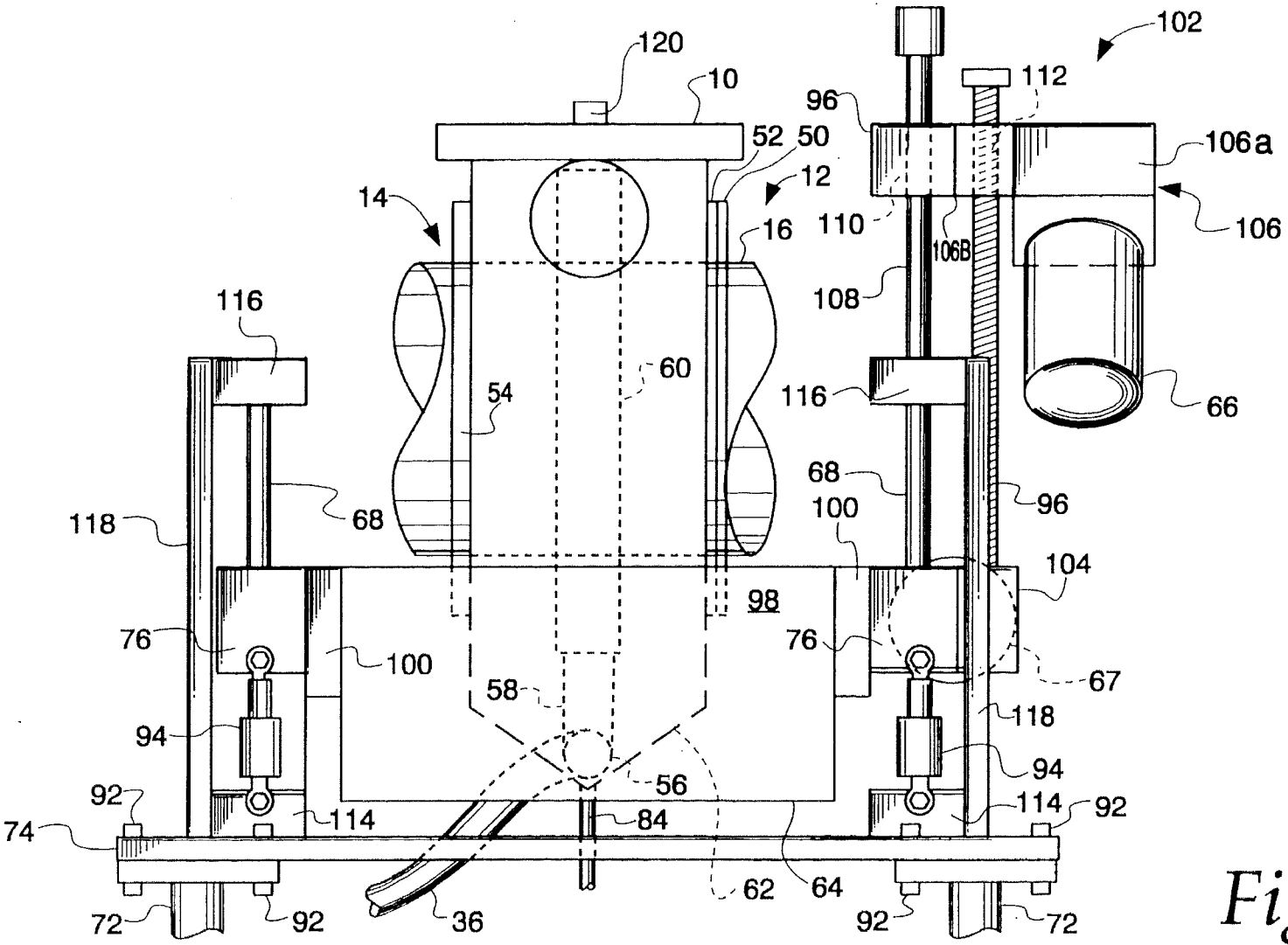
FIG. 3A is a diagrammatic front elevational view of a portion of FIG. 3, shown on an enlarged scale.

The apparatus further comprises one or more vacuum/supply systems for supplying coating material to the coating chamber in liquid phase, and withdrawing air with particles or droplets of coating material entrained therein to maintain the chamber interior at subatmospheric pressure. FIG. 1 illustrates two vacuum/supply systems 20, 22 disposed side-by-side.

Airflow into the coating chamber 10 through the exit port strips excess coating material from the tubing surface and carries it back into the chamber interior. Coating thickness may be controlled by regulating velocity of airflow and vacuum.

In the illustrated embodiment, each vacuum/supply system comprises first and second separation chambers 24 and 26, wherein particles of liquid coating material are separated from the air withdrawn from the coating chamber, and a pair of vacuum pumps 28 to draw air through the separation chambers from the coating chamber 10. The separation chambers 24 and 26 are connected to the coating chamber by a vacuum line 30.

Liquid coating material is supplied to the coating chamber 10 from a reservoir 32 in the vacuum/supply unit by a supply pump 34 which effects flow of coating material through a supply line 36 from the reservoir 32 to the coating chamber 10.

A problem which may be encountered in any operation in-line with manufacture of a length of continuous steel tubing is that a major displacement known as a "fold-up" may occur, wherein a portion of the length of tubing is folded or bent due to a downstream stoppage of travel. The tubing is typically supported from below by rollers along most of its length. Accordingly, a fold-up typically results in the affected portion being displaced substantially upward. To minimize damage to components of the coating system in the event of such mishaps, the coating chamber 10 is preferably spaced from the vacuum/supply system, and the vacuum line 30 is flexible or breakable so that the coating chamber 10 can move relative to the separation chamber 26 or break away therefrom in the event of a major displacement of the steel tubing.

The supply line which carries coating material to the coating chamber is, like the vacuum line, preferably of a flexible or breakable construction as well. The supply line may comprise a flexible hose.

A control system is preferably provided to sense fold-ups and to stop pumping of liquid coating material in response thereto. To this end, a limit switch may be positioned above the length of tubing 16 near the coating chamber to detect major upward displacements.

In the illustrated embodiment, in each vacuum/supply system the separation chambers 24 and 26 are positioned side-by-side and are capable of functioning independently of one another. Preferably, the separation chambers 24 and 26 are normally connected in series for optimal removal of entrained coating material from the air being drawn therethrough. To permit maintenance to take place on one of the separation chambers without interrupting coating operations, the chambers 24 and 26 are also capable of being connected in parallel with one another so that one chamber may be taken off-line for maintenance while the other continues to function.

Figure 5:
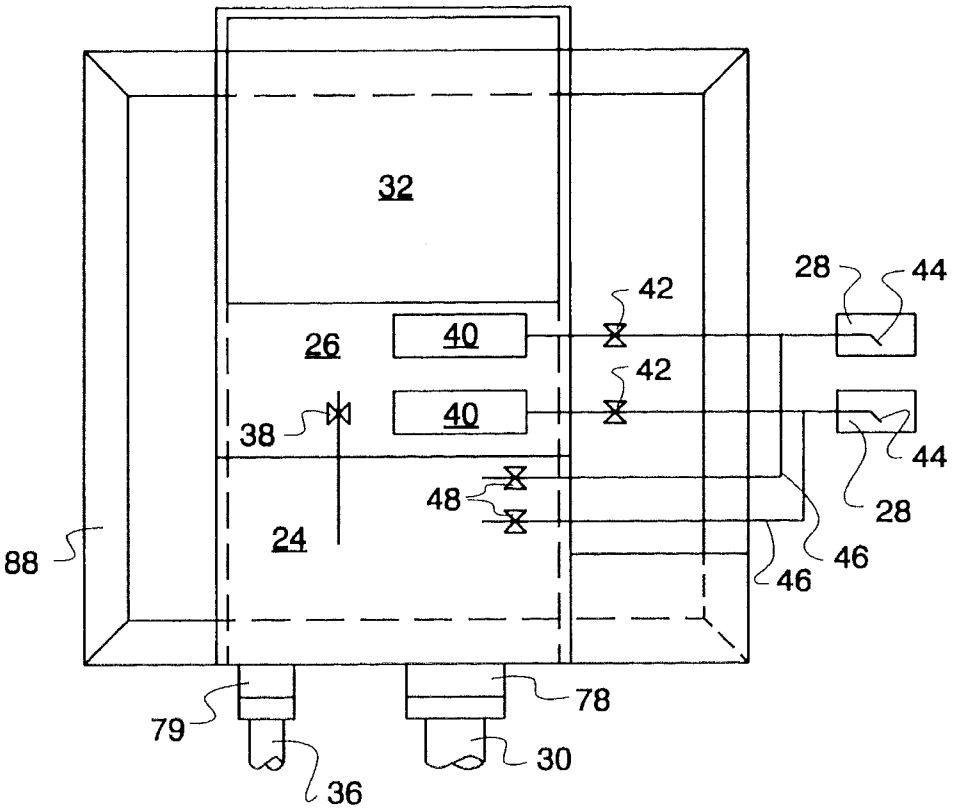
FIG. 5 is a diagrammatic plan view of a portion of the apparatus shown in FIG. 1.
Figure 4:
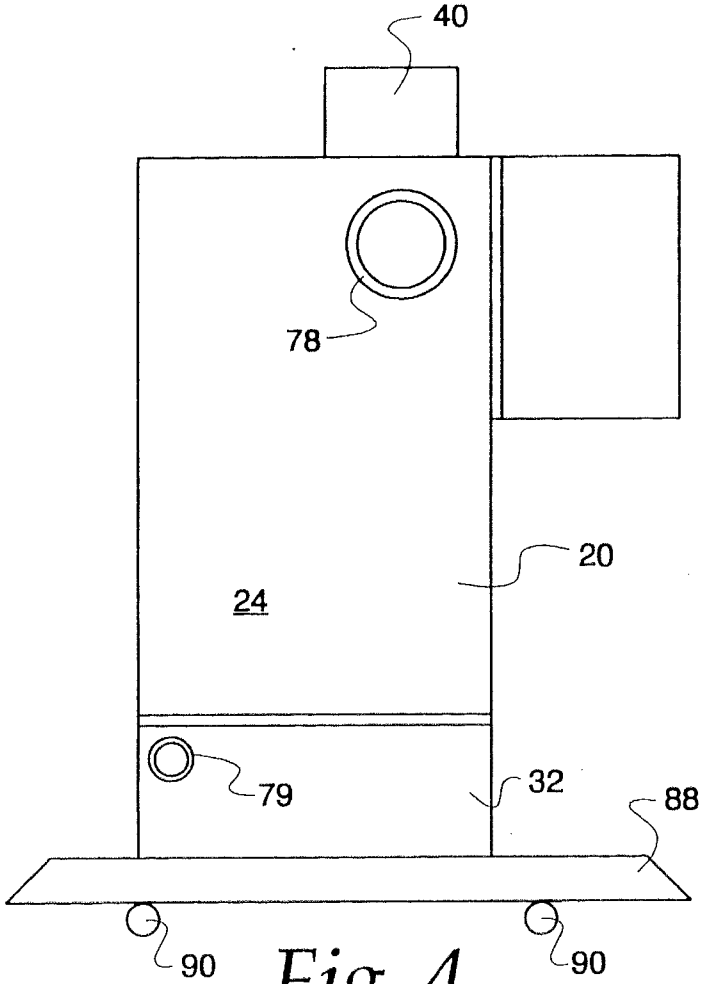
FIG. 4 is a diagrammatic front elevational view of a portion of the apparatus shown in FIG. 1.

In the illustrated embodiment, during normal operation, air flows from the coating chamber 10 through the vacuum line 30 into the first separation chamber 24, then through a pair of parallel valves 38 into the second separation chamber 26, then through a pair of parallel filters 40 disposed atop the second separation chamber 26, and from there through a second pair of parallel valves 42 disposed shortly downstream of the filters, to the inlets 44 (FIG. 5) of the vacuum pumps 28. However, air may also flow directly from the first separation chamber 24 to the pump inlets 44 through a pair of bypass vacuum lines 46 which are normally closed by a third pair of parallel valves 48.

When it is desired to service the filters 40, the third pair of valves 48 are opened, and the first and second pairs of valves 38 and 42 are closed. Air is thus shunted directly from the first separation chamber 24 to the vacuum pumps, bypassing the second separation chamber 26.

The separation chambers 24 and 26 in the illustrated embodiment are disposed over the reservoir 32 containing the liquid coating material.

The coating chamber 10, as noted above, has entry and exit ports 12 and 14 through which the continuous length of tubing passes. A seal 50 is preferably provided at the entry port 12 to engage the exterior surface of the tubing and minimize airflow into the coating chamber through the entry port. The seal is preferably made of a flexible material and may, for example, be made of a suitable fabric or elastomer or paperboard. The seal 50 preferably contacts the exterior of the tubing about its entire periphery to effect a wiping action thereagainst.

The seal 50 is preferably mounted on a mask 52 which is affixed to the entrance port. A similar mask 54 is provided at the exit port. Both masks are adjustable vertically and horizontally to enable fine-tuning of alignment after the coating chamber has been positioned as desired. The mask 54 at the exit port does not have a seal associated therewith. At the exit port, airflow into the coating chamber is desired to control the thickness of the coating, and clearance is accordingly provided between the mask 54 and the tubing exterior. The masks 52 and 54 are sized so as to have the same shape as the profile of the steel tubing passing therethrough, with sufficient clearance about the exterior of the tubing to avoid contact between the tubing and the masks. At the exit port, any such contact could adversely affect the coating.

Liquid coating material is supplied to the coating chamber 10 through an opening 56 in the coating chamber. The liquid coating material flows upward through a suitable supply pipe 58 in the interior of the coating chamber to an applicator 60 which applies the liquid coating material to the steel tubing. The position of the applicator may be adjustable, and to this end, an external mechanism may be provided to vary the position of the applicator 60 within the coating chamber 10. In one embodiment, the applicator is a ring which completely surrounds the steel tubing and floods liquid coating material onto the tubing exterior from all sides. In other embodiments, the applicator may take other forms. For example, the applicator may simply comprise a nozzle or opening at the end of the supply pipe positioned above the tubing to flood liquid coating material onto the top of the tubing.

To prevent spillage of excess liquid coating material, the apparatus preferably includes a control system which prevents the liquid supply pump from operating when the vacuum is not functioning. A basin may be provided beneath the coating chamber 10, and drain holes may be provided near the bottom of the coating chamber so that if liquid begins to accumulate in the coating chamber it will drain into the basin. The basin may be connected to a drain hose to carry excess liquid coating material to a suitable receptacle.

In the illustrated embodiment, the vacuum line 30 extends substantially horizontally from the side of the coating chamber at an elevation approximately halfway between the top and bottom of the coating chamber, and is positioned substantially perpendicular to the tubing.

A problem which may arise in continuous operation is that, during normal operation, the tubing 16 may be subjected to small vertical displacements due to periodic impact loads on the tubing by a vertically traveling cutoff blade downstream from the coating apparatus. To maintain the coating chamber 10 properly positioned relative to the tubing, the coating chamber preferably rides on the tubing so that the coating chamber shifts slightly upward and downward in response to like displacement of the tubing. To this end, the coating chamber is supported on a frame 64 upon which are mounted a pair of rollers 66 which engage the upper surface of the tubing, and a third roller 67 which engages the tubing from below. The frame 64 is slidably supported on four fixed vertical rods 68 in the illustrated embodiment so that the coating chamber 10 is constrained for vertical rectilinear travel. The coating chamber frame 64 has collars 76 associated with each of the vertical rods 68 and in sliding engagement therewith.

The frame 69 includes a pair of side frame members 98 and a pair of transverse members 100 which form a generally rectangular box about the lower end of the coating chamber 10. The frame 69 further comprises a structure 102 for supporting upper rollers 66 and lower roller 67, and a mechanism for permitting adjustment of the spacing between the upper rollers 66 and the lower roller 67 to accommodate tubing of variable diameter. The structure 102 comprises a pair of lower supports 104 mounted on one of the transverse members 100 for supporting the lower roller 67 at its opposite ends; an upper support member 106 supporting the upper rollers 66 for rotation; and a pair of vertical rods 108 rigidly supported on the lower support members 104 and extending upward to support the upper support member 106. The upper support 106 comprises a central block **106*a* and a transverse member 106*b* which has a pair of vertical bores 110 therein which engage the rods 108 in sliding contact so that the upper rollers 66 may be raised and lowered relative to the lower roller 67. The position of the upper support 106 relative to the lower supports 104 is determined by engagement between a pair of rotatable, vertical threaded rods 96 and a pair of threaded bores 112 in the transverse member 106*b* of the upper support 106. The threaded rods 96 are supported for rotation at their lower ends by the lower supports 104. Thrust bearings 94 extend between the collars 76 on the movable frame and supports 114 on the fixed platform 74, and function as shock absorbers to dampen vibrations and control displacement of the movable frame 64**.

The fixed rods 68 are supported on an adjustable base 70 which permits adjustment of the height and attitude of the coating chamber. In the illustrated embodiment, the base includes four screw jacks 72 positioned at the corners of the base supporting a platform 74 on which the vertical rods 68 are supported. The vertical rods 68 extend upward from lower supports 114 on the platform 74 to upper supports 116 disposed at the upper ends of vertical beams 118. To permit the coating chamber 10 to break away from the adjustable base 70 in the event of a mishap, the screw jacks 72 are attached to the platform 74 by breakable fasteners 92 such as nylon bolts.

As noted above, to permit rapid changeover from one coating material to another, the illustrated apparatus includes two independent vacuum/supply systems 20 and 22. In accordance with a preferred method of operation, changing the coating operation from one coating material to another is accomplished by disconnecting the coating chamber 10 from one vacuum/supply system, flushing the coating chamber and the vacuum and supply lines 30 and 36, and then connecting the coating chamber 10 to the other vacuum/supply system. The coating chamber 10 remains in place on the tubing 16 throughout the changeover to minimize line down time. The supply line 36 and the vacuum line 30 are preferably both provided with quick-disconnect fittings or other means to facilitate connection and disconnection to and from the respective vacuum/supply systems. The vacuum ports 78 on the respective systems are preferably positioned adjacent one another to reduce the distance that the respective units must be moved during changeovers. That is, the system 20 on the left in FIG. 1 has its vacuum port 78 positioned on the right, whereas the right-hand system 22 has its vacuum port on the left. In each system the supply port 79 is positioned on the opposite side from the vacuum port, providing a mirror-image relationship between the two systems.

The system which is not on-line may be cleaned by running a cleaning fluid therethrough. Where the system has been used with a water-based coating material, the cleaning fluid may be water. To facilitate cleaning of the system, a dummy box 80 may be employed to connect the outlet port with the vacuum inlet port of the system.

To permit liquid coating material to be drained from the coating chamber during the changeover, a receptacle 82 is preferably provided adjacent the coating chamber 10, and a drain fitting 84 with a manually operable valve 86 is provided at the bottom of the chamber 10. The coating chamber is preferably flushed with a suitable cleaning fluid therethrough during the changeover.

Each vacuum/supply system may be supported on a movable base 88 which is supported on wheels 90. If desired, the wheels may ride on rails to guide the vacuum/supply apparatus in rectilinear movement in a direction parallel to the tubing line. As indicated by the arrows in FIG. 1, each system is shifted to the left to change from the system on the left to the system on the right.

From the foregoing it should be appreciated that the invention provides a novel and improved method for continuous coating of continuously manufactured metal tubing. The invention is more particularly pointed out in the following claims.

What is claimed is:

1. Coating apparatus for applying a coating to a continuous length of horizontally oriented metal tubing in-line with apparatus for forming said tubing continuously, comprising:

a coating chamber for enclosing a portion of said tubing while permitting said tubing to pass continuously therethrough, said coating chamber having an entry port and an exit port for passage of said continuous length of tubing therethrough, a vacuum port for outflow of air from said chamber, and a liquid supply port for inflow of liquid coating material;

a reservoir of coating material;

a supply line for carrying coating material from said reservoir to said liquid supply port;

a supply pump for effecting flow of coating material through said supply line and into said coating chamber through said supply port;

a vacuum line connected to said vacuum port for receiving outflow of air from said coating chamber;

a primary separation chamber for receiving airflow from said vacuum line and effecting separation of air from coating material; and a vacuum pump maintaining subatmospheric pressure in said primary separation chamber so that ambient air flows into said coating chamber through said exit port, then through said vacuum line to said primary separation chamber;

said coating chamber being spaced from said primary separation chamber and being movable relative to said primary separation chamber during coating of said tubing to avoid damage to said primary separation chamber in the event of displacement of said coating chamber by said length of tubing.

2. Coating apparatus in accordance with claim 1 wherein said vacuum line is flexible.

3. Coating apparatus in accordance with claim 1 wherein said vacuum line is breakable.

4. Coating apparatus in accordance with claim 1 further comprising a secondary separation chamber for receiving outflow from said first separation chamber during normal operation, and means for enabling said secondary separation chamber to be taken off-line for maintenance while said primary separation chamber remains on-line, without interruption of coating.

5. Coating apparatus in accordance with claim 1 wherein said coating chamber includes an entry mask and an exit mask which respectively define said entry port and said exit port, said entry mask and said exit mask being selectively adjustable relative to said coating chamber to facilitate centering of the metal tubing in said entry port and said exit port, and wherein said entry port includes a seal for restricting flow of air into said entry port so that flow of air into said entry port is more restricted than flow of air into said exit port.

6. Coating apparatus in accordance with claim 1 further comprising an adjustable mechanism for supporting said coating chamber on said tubing to facilitate positioning of said coating chamber relative to said tubing.

7. Coating apparatus in accordance with claim 1 wherein said coating chamber includes a manually operable drain which may be maintained in a sealed configuration during coating, and which may be shifted to an open configuration for cleaning of the coating chamber during interruptions in coating operations.

8. Coating apparatus in accordance with claim 1 wherein said coating chamber has a seal at its entry port for engaging said tubing and restricting flow of air into said entry port around said tubing.

9. Apparatus in accordance with claim 1 wherein said coating chamber is spaced from said reservoir and is movable relative to said reservoir during coating of said tubing to avoid damage to said reservoir in the event of displacement of said coating chamber by said length of tubing.

10. Coating apparatus in accordance with claim 9 wherein said supply line is flexible.

11. Coating apparatus in accordance with claim 9 wherein said supply line is breakable.

12. A method of applying a coating to a continuous length of horizontally oriented metal tubing in-line with apparatus for continuously manufacturing said tubing, said method comprising:

providing a reservoir of coating material;

providing a coating chamber for enclosing a portion of said tubing;

continuously advancing said tubing through said coating chamber;

continuously supplying coating material from said reservoir to said coating chamber and applying said coating material to said tubing in said coating chamber;

effecting airflow into said coating chamber about the exterior of said tubing as said tubing exits said coating chamber by continuously withdrawing air from said coating chamber through a vacuum port;

receiving airflow from said coating chamber in a separation chamber and effecting separation of air from coating material entrained therein within said separation chamber; and maintaining said coating chamber spaced from said separation chamber and movable relative to said separation chamber during coating of said tubing to avoid damage to said separation chamber in the event of displacement of said coating chamber by said length of tubing.

13. A method in accordance with claim 12 wherein said coating chamber comprises an entry port and an exit port for said tubing and wherein said method further comprises the step of engaging said tubing at said entry port with a flexible seal so that flow of air into said coating chamber through said entry port is restricted more than flow of air into said coating chamber through said exit port.

* * * * *